US006441593B1

(12) United States Patent
Saripella

(10) Patent No.: US 6,441,593 B1
(45) Date of Patent: Aug. 27, 2002

(54) LOW NOISE SWITCHING REGULATOR

(75) Inventor: Satish C. Saripella, Starkville, MS (US)

(73) Assignee: Cypress Semiconductor Corp., San Jose, CA (US)

( * ) Notice: Subject to any disclaimer, the term of this patent is extended or adjusted under 35 U.S.C. 154(b) by 0 days.

(21) Appl. No.: 09/736,907

(22) Filed: Dec. 14, 2000

(51) Int. Cl.[7] ..... G05F 1/40; G05F 3/16
(52) U.S. Cl. ..... 323/268; 323/314; 327/530
(58) Field of Search ..... 323/268, 282, 323/284, 285, 286; 327/536, 530; 365/226

(56) References Cited

U.S. PATENT DOCUMENTS 5,422,562 A * 6/1995 Mammano et al. ..... 323/282
5,553,030 A * 9/1996 Tedrow et al. ..... 365/226
5,563,501 A * 10/1996 Chan ..... 323/282
5,734,277 A * 3/1998 Hu et al. ..... 327/108
6,046,896 A * 4/2000 Saeki et al. ..... 361/86
6,091,594 A * 7/2000 Williamson et al. ..... 361/111
6,097,235 A * 8/2000 Hsu et al. ..... 327/309
6,184,670 B1 * 2/2001 Mulatti et al. ..... 323/314

* cited by examiner

*Primary Examiner*—Rajnikant B. Patel
(74) *Attorney, Agent, or Firm*—Christopher P. Maiorana, P.C.

(57) ABSTRACT

An apparatus comprising a first device and a second device. The first device may be connected to a first supply voltage. The second device may be connected (i) in series with the first device and (ii) to a second supply voltage. The first device is generally biased to provide enhanced noise suppression performance. The second device is generally configured to switch between the first and second supply voltages.

21 Claims, 6 Drawing Sheets

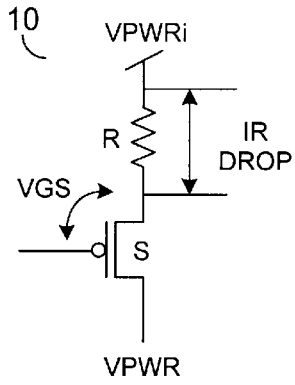
(CONVENTIONAL)
FIG. 1
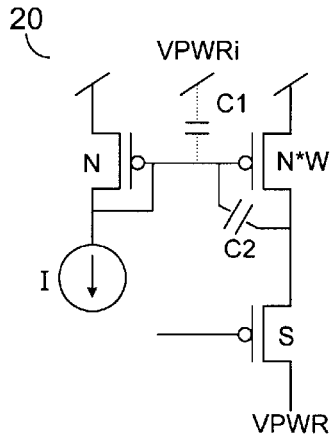
(CONVENTIONAL)
FIG. 2

LOW NOISE SWITCHING REGULATOR

FIELD OF THE INVENTION

The present invention relates to a method and/or architecture for implementing a regulator device generally and, more particularly, to a method and/or architecture for implementing a low noise switching regulator.

BACKGROUND OF THE INVENTION

Several conventional approaches for implementing regulator circuits have been developed. Regulator circuits connect one supply voltage (e.g., an external supply voltage) with another voltage (e.g., an internal supply voltage). Referring to FIG. 1, a circuit 10 implementing one such conventional approach is shown. The circuit 10 may be easily implemented and is area efficient. However, the circuit 10 has the disadvantages of a large voltage overshoot when operating with a high external supply voltage VPWRI. As large currents build up (as in the case of high external supply voltages), the ohmic drop (i.e., IRDROP) across the resistance R limits the gate drive of the switch S, reducing the total current. The reduction of current may not be sufficient and may result in higher overshoot. The resistor R is chosen such that little impact occurs to performance at a low operating range of the internal supply voltage VPWR.

In the circuit 10, the series resistance R is sized such that a low external power supply voltage (VPWRI) does not compromise the internal voltage (VPWR) under high current conditions. For low external supply voltages, the current drop (IRDROP) due to the series resistance R is not significant. At higher external voltages, when the switch S turns on in response to a load condition, a sudden current can flow tending to equalize the internal supply voltage to the external supply voltage. The current flow causes an ohmic voltage drop across the resistor R.

The increased ohmic drop lowers the gate to source voltage VGS seen by the switch S. In the absence of the resistor R, the switch S can see all the gate to source voltage VGS from the external supply VPWRI to the ground. With the series source resistance, the switch S has a lower gate to source drive which operates at a lower current. Operating at a lower current does not compromise performance on a lower power supply voltage but can reduce peaking current at higher power supply voltage. A wide voltage range is generally undesirable with the circuit 10 but may be suitable for some applications.

Referring to FIG. 2, a circuit 20 of another conventional approach for implementing a regulator is shown. The circuit 20 uses a current source I in series with the PMOS switch S. The circuit 20 may have better, but still limited, performance compared with the circuit 10. A large de-coupling capacitor Cl is implemented to suppress a coupling effect of the circuit 20. The circuit 20 has the disadvantage of requiring a large die area. The circuit 20 also consumes DC current, which is generally undesirable.

Consider the circuit 20, for example, when 100 mA is required. The internal supply voltage VPWR must be at a certain voltage. The current source must handle the current regardless of the external voltage VPWRI. Even if the external voltage VPWRI were to change between a normal 2.3 volts to a higher 3.7 volts, the current source still must provide the same current through the biased PMOS series device.

A disadvantage of the conventional implementation 20 is that the bias that controls the current source is affected by the transient response of the switch S. The effect is partially in response to the gate of the current source in series with switch S being modulated by the transient. A large capacitance can be added to power or ground to decouple the gate for minimum modulation on the gate. Reducing the modulation can provide a constant current through the switch S. Thus, the additional capacitance is effective in controlling the current.

As the external supply voltage VPWR increases the current is still limited by the current source. A typical approach for implementing a large current source is by mirroring the bias voltage from a smaller device supporting a small current. During a transient event (i.e., turn ON or OFF of the switch S), the drain of the current limiting device (N*W) drops and capacitively couples the capacitor C2 to the mirror bias voltage. Such capacitive coupling has the undesirable effect of making the current source go into overdrive, resulting in large currents. A large decoupling capacitance C1 may be used to lower the effect of coupling. An alternative solution is to provide a coupling effect that is equal and opposite in direction, to produce a net zero charge transferred to the bias node. The circuit 20 is costly to implement, requires significant die area, and has increased design complexity.

The conventional circuits 10 and 20 have disadvantages that include (i) large voltage overshoot on a regulated voltage supply, (ii) large di/dt noise which affects circuit performance, (iii) considerable cost and/or (iv) a large die area impact.

SUMMARY OF THE INVENTION

The present invention concerns an apparatus comprising a first device and a second device. The first device may be connected to a first supply voltage. The second device may be connected (i) in series with the first device and (ii) to a second supply voltage. The first device is generally biased to provide enhanced noise suppression performance. The second device is generally configured to switch between the first and second supply voltages.

The objects, features and advantages of the present invention include providing a method and/or architecture for implementing a low noise switching regulator that may (i) have excellent noise suppression; (ii) deliver optimal performance; (iii) provide an open loop regulator in series with a switching regulator to provide enhanced noise performance; (iv) provide an open loop regulator including a native (or depletion) device; (v) provide a low noise switching regulator; and/or (vi) reduce voltage ranges of an internal regulator switch.

BRIEF DESCRIPTION OF THE DRAWINGS

These and other objects, features and advantages of the present invention will be apparent from the following detailed description and the appended claims and drawings in which:

FIG. 1 is a diagram of a conventional switching regulator;

FIG. 2 is a diagram of another conventional switching regulator;

DETAILED DESCRIPTION OF THE PREFERRED EMBODIMENTS

Figure 3:
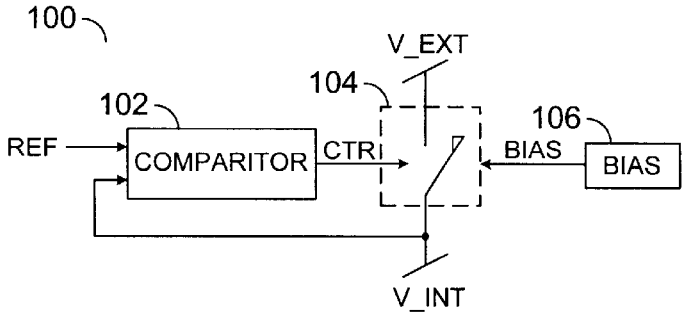
FIG. 3 is a block diagram of a preferred embodiment of the present invention.

Referring to FIG. 3, a block diagram of a circuit 100 is shown in accordance with a preferred embodiment of the present invention. The circuit 100 generally comprises a circuit 102, a circuit 104 and a circuit 106. The circuit 102 may be implemented, in one example, as a comparator circuit. The comparator 102 may be a switching regulator comparator circuit. The circuit 104 may be implemented, in one example, as a switch circuit in series with an open loop regulator circuit (to be described in more detail in connection with FIG. 4). The circuit 106 may be implemented, in one example, as a bias circuit. The switch circuit 104 may be connected to both an external voltage supply (e.g., V_EXT) and an internal voltage supply (e.g., V_INT). The bias circuit 106 may present a signal (e.g., BIAS) to the circuit 104. The comparator circuit 102 may present a control signal (e.g., CTR) to the switch 104. The signal CTR may be generated in response to the internal supply V_INT and a reference signal (e.g., REF).

The circuit 100 may lower the noise generated by the switch 104 during transient periods (e.g., turning ON and OFF). One design concern when implementing a wide voltage range switching regulator is that such designs may need to meet a certain performance at a low end of an operating range of the supply voltage. However, when operating at the high end of the operating range of the supply voltage, the resistance of the switch 104 is significantly lowered. In such a case, without the present invention, the switch 104 may become a significant noise source on the package (or integrated circuit) as discussed in the background section. The circuit 100 generally reduces the noise generated by the switch 104 when operating at high operating supply voltages.

Figure 4:
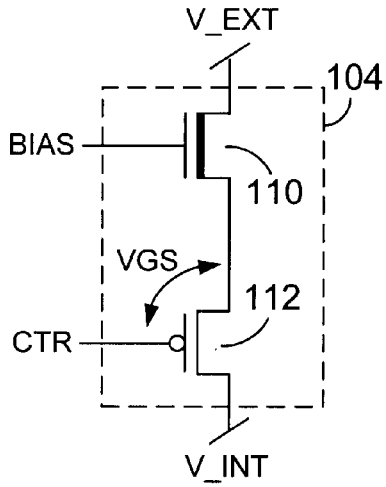
FIG. 4 is a diagram of a portion of the circuit of FIG. 5.

Referring to FIG. 4, a schematic diagram of the switch 104 is shown. The switch 104 generally comprises a device 110 and a device 112. The device 110 may have a gate that receives the signal BIAS. The device 112 may have a gate that receives the signal CTR. A first source/drain of the device 110 may be connected to the supply voltage V_EXT. A second source/drain of the device 110 may be connected to a first source/drain of the device 112. The second source/drain of the device 112 may be connected to the supply voltage V_INT. A voltage (e.g., VGS) may be generated between the first source/drain and the gate of the device 112.

The device 110 may be implemented, in one example, as a native device. A native device may be a device where the threshold voltage (e.g., Vt) may be zero, or near zero. While such native devices may be difficult to control (e.g., turn off) in certain applications, native devices can be used in the context of the present invention to provide increased voltage protection. However, the present invention is not limited to implementing the device 110 as a native device.

The device 110 is inserted in series with the source of the PMOS device 112. The voltage signal BIAS is generated to be lower than the maximum external voltage V_EXT. The signal BIAS is presented to the gate of the device 110 to limit the total voltage range received by the switch 104. When the switch 104 sees a lower voltage (relative to the external supply voltage V_EXT), the total di/dt noise that is generated is lowered. The device 110 and the value of the voltage signal BIAS may be selected such that the performance is not compromised at the low end of the external supply voltage V_EXT.

The resistance of the device 110 may be altered dynamically (e.g., non-linearly) as a function of the external supply voltage V_EXT. The resistance of the device 110 is generally controlled by the voltage BIAS. For example, the smaller the voltage signal BIAS, the larger the resistance of the device 110. A simple resistor (such as in the circuit 10 of FIG. 2) cannot realize such a property. Therefore, the circuit 100 is superior to the technique of the circuit 10 of FIG. 1.

Figure 5:
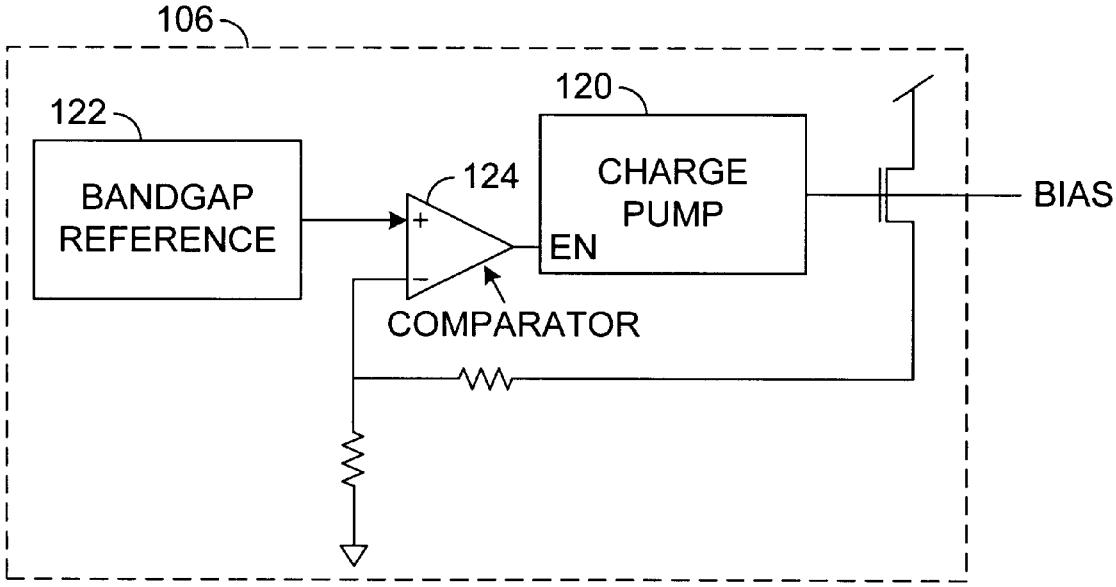
FIG. 5 is a detailed block diagram of the bias circuit of FIG. 3.

Referring to FIG. 5, an example of the bias circuit 106 is shown. The circuit 106 generally comprises a charge pump 120, a reference circuit 122 and a comparator circuit 124. The reference circuit 122 may be implemented as a bandgap reference circuit. However, other reference circuits may be implemented accordingly to meet the design criteria of a particular implementation. The charge pump circuit 120 may be implemented to generate the signal BIAS of a voltage level higher than the low end of the external supply voltage V_EXT. Since the gate bias on the native device is constant, for high external voltages the device saturates and provides a constant current rather than large surge current which causes noise.

The circuit 106 may illustrate a preferred implementation of a bias circuit. The key to lowering the switching noise of the switch 104 is to place a series element (e.g., the device 110) to reduce current under high voltage conditions. A source follower NMOS or native device receiving a fixed gate bias may serve as a good current limiter.

The requirement for the bias voltage BIAS for wide external supply voltage range may be implemented such that, at low external supply voltages, the series device 110 should have a low resistance so that the performance is not compromised. In order to meet this requirement, the bias voltage BIAS may be higher than the available supply voltage on the low side of the range. Therefore, a charge pump may become necessary. If adequate external supply voltage is available, the various schemes (such as those to be described in connection with FIGS. 6 and 7) may be implemented.

The bandgap reference circuit 122 generally provides a fixed reference to the comparator 124. The comparator 124 may enable the charge pump 120 to charge up a bias node until a desired value for the signal BIAS is achieved. The value BIAS is generally set by the desired resistance of the native device 110 under low supply voltage conditions. Once the desired value is reached, the charge pump 120 is disabled and the value BIAS is left floating on the gate of the native device 110. Additional circuitry (not shown) is used to ensure that the value BIAS does not drift above or below the desired value.

Figure 6:
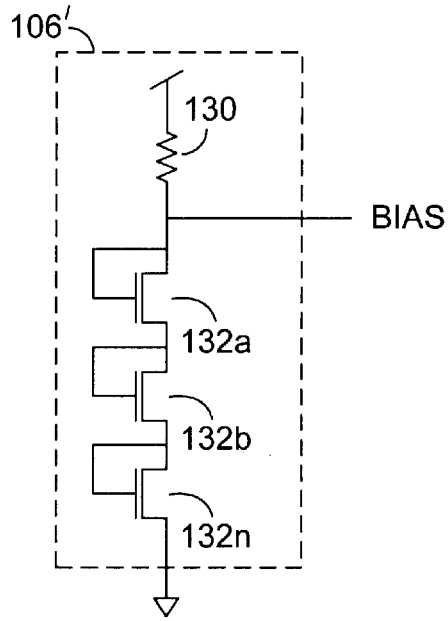
FIGS. 6 and 7 are alternate methods of bias generation.

Referring to FIG. 6, a circuit 106' implementing an alternate bias scheme is shown. The circuit 106' may have similar function to the circuit 106. The circuit 106' generally comprises a resistor 130 and a number of MOS diodes 132*a*–132*n* coupled in a series configuration. The resistor 130 and the switches 132*a*–132*n* may be configured to generate the voltage signal BIAS. The circuit 106' may provide a simplistic bias circuit. However, the circuit 106' may have a poor supply rejection. The circuit 106' may also require a high external supply voltage.

Figure 7:
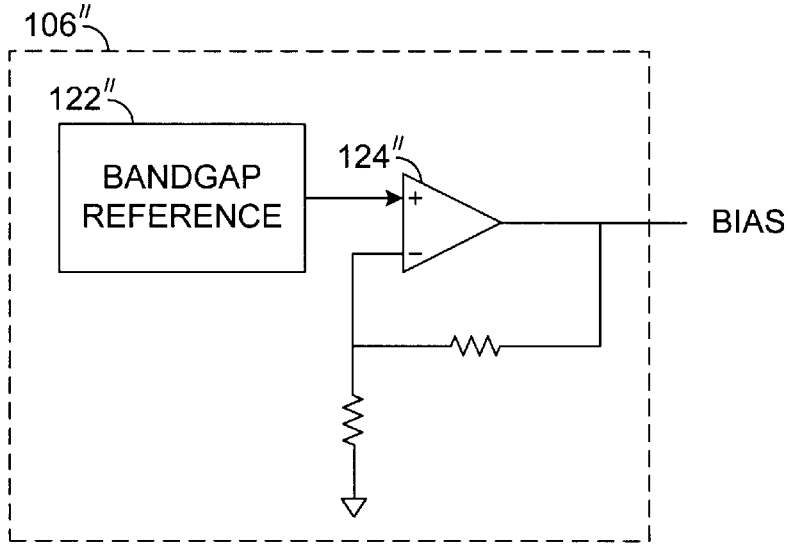

Referring to FIG. 7, a circuit 106" implementing another alternate bias scheme is shown. The circuit 106" generally comprises an OPAMP 124" and a bandgap reference circuit 122". The OPAMP 124" may be designed for a small transient requirement and low supply rejection properties. However, the circuit 106" may require a high external supply voltage to properly operate.

Figure 8A:
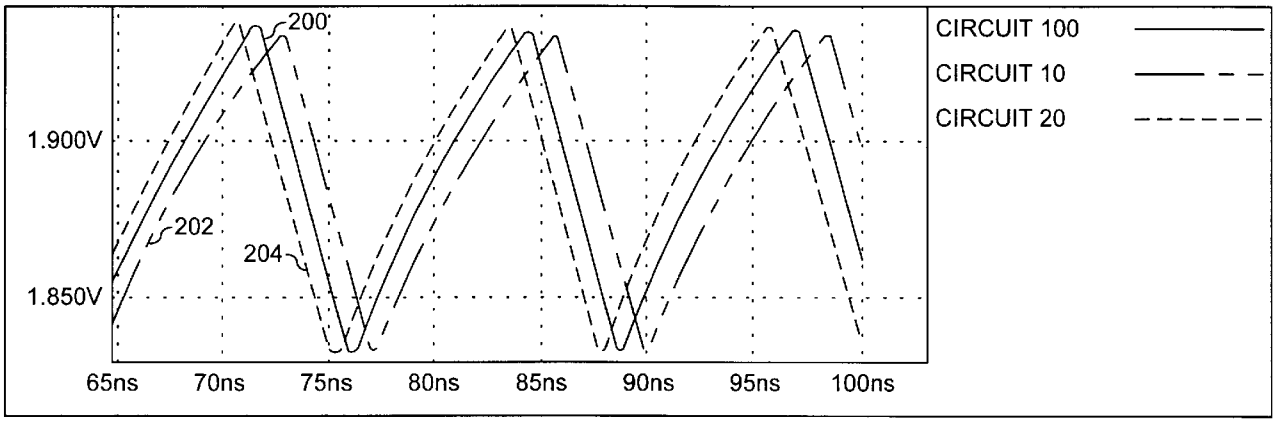
FIGS. 8(*a–b*) are timing diagrams illustrating an operation of the present invention compared with conventional approaches all operating under low supply voltage condition.
Figure 8B:
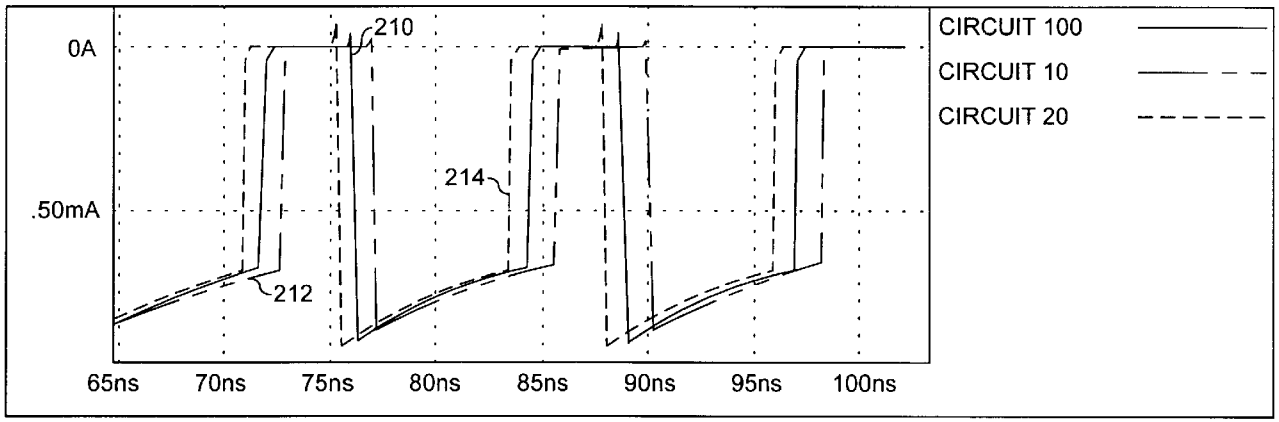

Referring to FIGS. 8(*a–b*) , performance of the circuit 100 compared with the circuits 10 and 20, while operating at a minimum external supply voltage is shown. FIG. 8*a* illustrates an internal supply voltage 200 of the circuit 100, 202 of the circuit 10 and 204 of the circuit 20 at a minimum external supply voltage. FIG. 8*b* illustrates the associated switching currents 210 of the circuit 100, 212 of the circuit 10 and 214 of the circuit 20. The average internal voltage is similar for all three schemes.

Figure 9A:
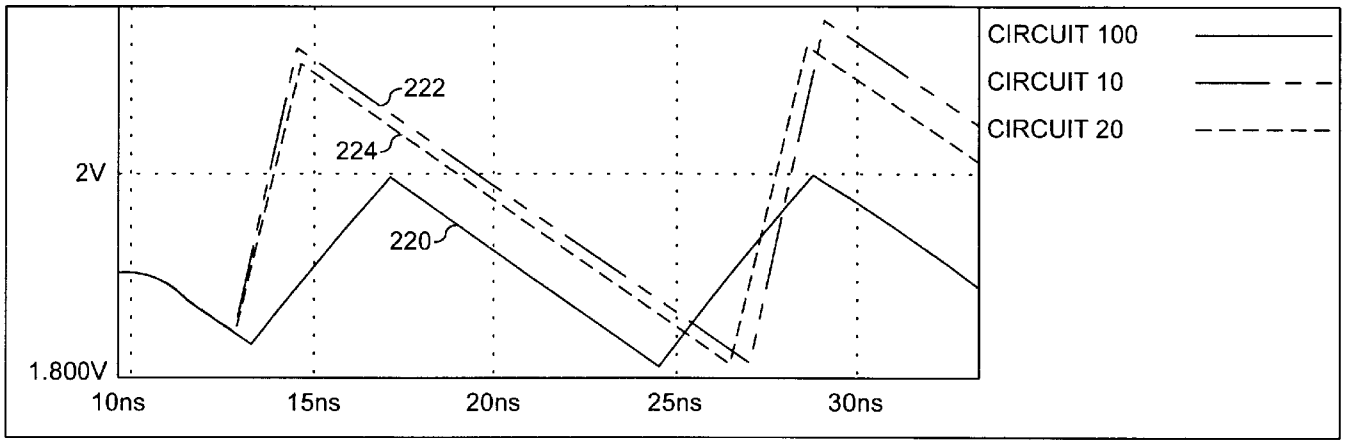
FIGS. 9(*a–b*) are timing diagrams illustrating an operation of the present invention compared with conventional approaches (i.e., where the circuit 20 does not have a decoupling capacitor on the bias node) under high supply voltage conditions.
Figure 9B:
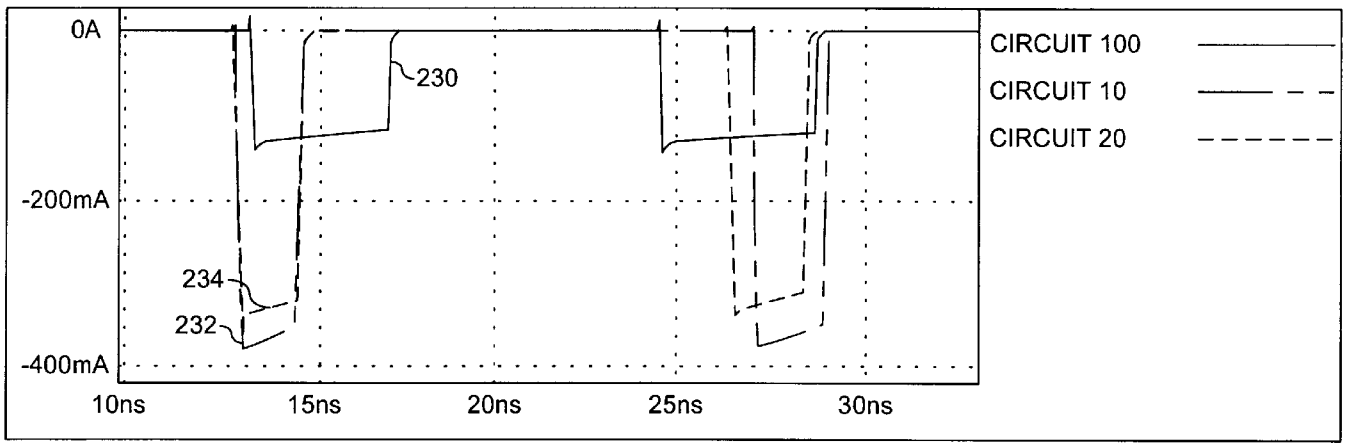

Referring to FIGS. 9(*a–b*), performance of the circuit 100 compared to the circuit 10 and the circuit 20, while operating at a maximum external supply voltage is shown. FIG. 9*a* illustrates an internal supply voltage 220 of the circuit 100, 222 of the circuit 10 and 224 of the circuit 20 at a high external supply voltage. FIG. 9*b* illustrates the associated switching currents 230 of the circuit 100, 232 of the circuit 10 and 234 of the circuit 20. The average current consumed by the circuit 100 shows an improvement over the circuits 10 and 20 (where the circuit 20 does not have the decoupling capacitor). The circuit 20 and the circuit 10 behave similarly without the decoupling capacitor on the circuit 20.

Figure 10A:
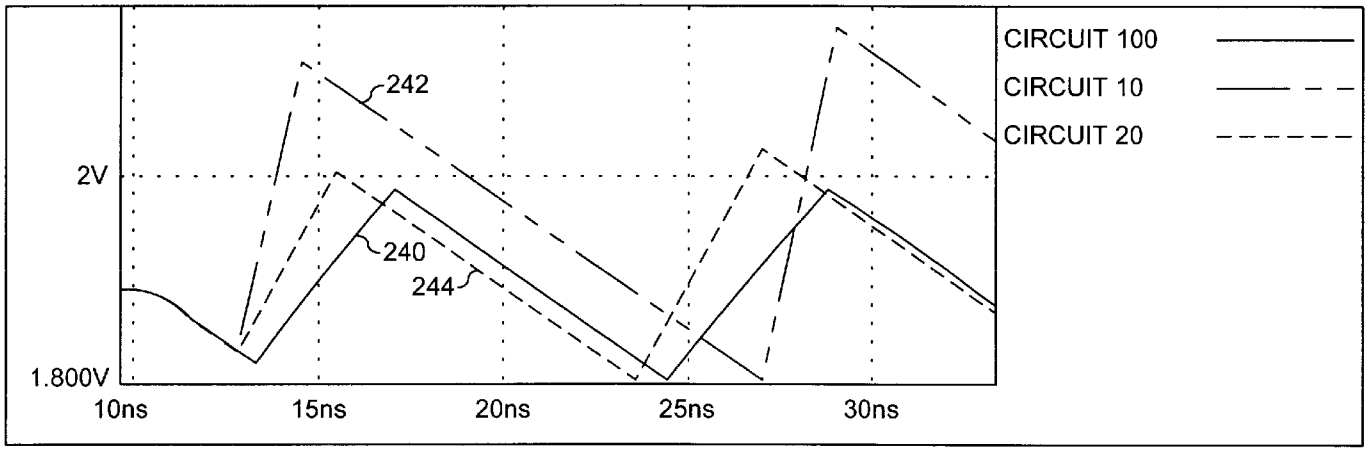
FIGS. 10(*a–b*) are timing diagrams illustrating an operation of the present invention compared with conventional approaches (i.e., where the circuit 20 has a decoupling capacitor on the bias node) under high supply voltage conditions.
Figure 10B:
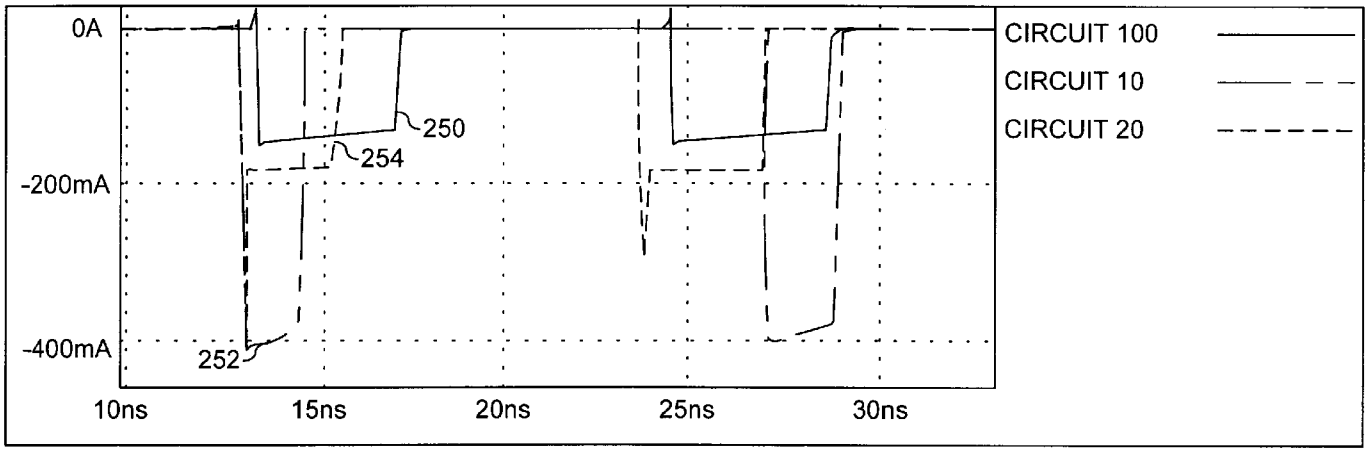

Referring to FIGS. 10(*a–b*), performance of the circuit 100 compared to the circuit 10 and the circuit 20, at a maximum external supply voltage is shown. FIG. 10*a* illustrates the internal supply voltage 240 of the circuit 100, 242 of the circuit 10 and 244 of the circuit 20 of a maximum external supply voltage. FIG. 10*b* illustrates the associated switching current 250 of the circuit 100, 252 of the circuit 10 and 254 of the circuit 20 (where the circuit 20 has the decoupling capacitor). The circuit 20 looks closer to the circuit 100, but the area penalty is large.

The circuit 100 may provide an improved noise performance (e.g., reducing the overall switching noise) while maintaining a relative ease of implementation. The circuit 100 may be particularly valuable in designs implemented with analog circuitry where noise should be kept to a minimum.

While the invention has been particularly shown and described with reference to the preferred embodiments thereof, it will be understood by those skilled in the art that various changes in form and details may be made without departing from the spirit and scope of the invention.

What is claimed is:

1. An apparatus comprising:

a first device connected to a first supply voltage; and a second device connected in series between said first device and a second supply voltage, wherein said first device is biased to provide enhanced noise suppression performance and said second device is configured to switch between said first and second supply voltages in response to said second supply voltage and a reference signal.

2. The apparatus according to claim 1, wherein a resistance of said first device is dynamically altered in response to an externally generated bias signal.

3. The apparatus according to claim 1, wherein a resistance of said first device is dynamically altered as a function of said first voltage supply.

4. The apparatus according to claim 1, wherein said first device is configured in response to a bias signal, wherein said bias signal comprises a voltage level lower than a maximum voltage level of said first supply voltage.

5. The apparatus according to claim 4, wherein said bias signal is presented to a gate of said first device to limit a total voltage range received by said second device.

6. The apparatus according to claim 5, wherein said second device is configured to generate lower noise in response to said limited total voltage range, wherein said limited total voltage range comprises a lower voltage than said first supply voltage range.

7. The apparatus according to claim 3, wherein said first device and said bias signal are configured such that a performance of said apparatus is not compromised at a low end of an operating range of said first supply voltage.

8. The apparatus according to claim 1, wherein said first device comprises an open loop regulator.

9. The apparatus according to claim 1, wherein said second device comprises a switching regulator.

10. The apparatus according to claim 1, wherein said first device is implemented as a native device or a depletion device.

11. The apparatus according to claim 1, wherein said apparatus comprises a low noise switching regulator.

12. The apparatus according to claim 1, wherein said first device is biased in response to a bias generator circuit.

13. An apparatus comprising:

means for connecting a first device to a first supply voltage and connecting a second device in series between said first device and a second supply voltage; and means for biasing said first device to provide enhanced noise suppression performance and said second device is configured to switch between said first and second supply voltages in response to said second supply voltage and a reference signal.

14. A method for providing a low noise switching regulator, comprising the steps of:

(A) connecting a first device to a first supply voltage;

(B) connecting a second device in series between said first device and a second supply voltage; and (C) biasing said first device to provide enhanced noise suppression performance when said second device is configured to switch between said first and second supply voltages in response to said second supply voltage and a reference signal.

15. The method according to claim 14, wherein step (C) further comprises:

dynamically altering a resistance of said first device in response to an externally generated bias signal.

16. The method according to claim 14, wherein step (C) further comprises:

dynamically altering a resistance of said first device as a function of said first voltage supply.

17. The method according to claim 14, wherein step (C) further is further responsive to a bias signal, wherein said bias signal comprises a voltage level lower than a maximum voltage level of said first supply voltage.

18. The method according to claim 17, wherein step (C) further comprises:

limiting a total voltage range received by said second device by presenting said bias signal to a gate of said first device.

19. The method according to claim 18, wherein step (C) further comprises:

generating lower noise with said second device in response to said limited total voltage range, wherein said limited total voltage range comprises a lower voltage than said first supply voltage range.

20. The method according to claim 14, wherein step (C) further comprises:

biasing said first device such that a performance of said low noise switching regulator is not compromised at a low end of an operating range of said first supply voltage.

21. An apparatus comprising:

a first device connected to a first supply voltage, wherein said first device comprises a native device biased to provide enhanced noise suppression performance; and a second device connected in series between said first device and a second supply voltage, wherein said second device is configured to switch between said first and second supply voltages.

* * * * *